US008651614B2

(12) United States Patent
Sakamoto et al.

(10) Patent No.: US 8,651,614 B2
(45) Date of Patent: Feb. 18, 2014

(54) INKJET PRINTING APPARATUS AND INK DISCHARGE CONTROL METHOD

(75) Inventors: Atsushi Sakamoto, Kawasaki (JP); Hitoshi Nishikori, Inagi (JP); Tomoki Yamamuro, Kawasaki (JP); Yasuyuki Hirai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 13/307,387

(22) Filed: Nov. 30, 2011

(65) Prior Publication Data

US 2012/0154472 A1 Jun. 21, 2012

(30) Foreign Application Priority Data

Dec. 15, 2010 (JP) ..... 2010-279861

(51) Int. Cl.
*B41J 29/393* (2006.01)
*B41J 25/308* (2006.01)

(52) U.S. Cl.
USPC ..... 347/19; 347/8

(58) Field of Classification Search
CPC ..... B41J 2/2135; B41J 25/308
USPC ..... 347/8, 16, 19, 37, 101, 104
See application file for complete search history.

(56) References Cited

U.S. PATENT DOCUMENTS

| | | | | |
|---|---|---|---|---|
| 7,530,660 | B2 * | 5/2009 | Yamanobe | 347/19 |
| 7,591,458 | B2 * | 9/2009 | Maki | 271/18.1 |
| 7,931,348 | B2 * | 4/2011 | Kida | 347/19 |

FOREIGN PATENT DOCUMENTS

| | | |
|---|---|---|
| JP | 2004-262557 A | 9/2004 |
| JP | 2008-110853 A | 5/2008 |

* cited by examiner

*Primary Examiner* — An Do
(74) *Attorney, Agent, or Firm* — Fitzpatrick, Cella, Harper & Scinto

(57) ABSTRACT

In an inkjet printing apparatus, a printing medium is conveyed in a conveying direction by causing the printing medium to adsorb to the surface of the endless belt by electrostatic force. When printing, the surface potential of the printing medium directly below the printing head is acquired. The discharge speed of the ink that has been associated in advance with the acquired surface potential is obtained, and an amount of variation in the landing position of the ink is determined based on the scanning speed of the printing head, the distance from the printing head to the printing medium, and the discharge speed of the ink. The timing of discharge of ink from the printing head is corrected to cancel out the determined amount of variation, and printing is performed based on image data in accordance with the corrected timing.

13 Claims, 13 Drawing Sheets

RELATIONSHIP BETWEEN DISCHARGING SPEED AND PAPER SURFACE POTENTIAL (PERCENTAGE)
MEASUREMENT DISTANCE: APPR. 1.0mm MAIN DROP

FIG. 7

| | | REGISTER ADJUSTMENT PATTERN IN PRINTING EXECUTION | |
|---|---|---|---|
| SURFACE POTENTIAL | 0 | −500. [v] | −1000. [v] |
| DISCHARGE SPEED | 14. [m/sec] | 16.5 [m/sec] | 19. [m/sec] |
| PAPER DISTANCE | 1.2 [mm] | 1.2 [mm] | 1.2 [mm] |
| CARRIAGE SPEED | 50. [inch/sec] | 50. [inch/sec] | 50. [inch/sec] |
| LANDING VARIATION ON PAPER SURFACE IN CARRIAGE SCANNING DIRECTION | 108.86 [μm] | 92.36 [μm] | 80.21 [μm] |
| X SHIFT AMOUNT FROM REFERENCE | −16.5 [μm] | . [μm] | 12.15 [μm] |
| BIDIRECTIONAL REGISTER ADJUSTMENT CORRECTION AMOUNT (UNITS OF 2400 dpi) | −3.1 | 0 | 2.3 |

FIG. 9

| | CARRIAGE SPEED | ALL 50 [inch/sec] | | | | | | |
|---|---|---|---|---|---|---|---|---|
| | POWER FEED CONDITION | −2.0 [kV] | | | | | | |
| | | | | | | | RESULT OF GRAY PATTERN GRANULAR QUALITY EVALUATION | |
| | TYPE OF PRINTING MEDIUM | THICKNESS [mm] | PAPER DISTANCE [mm] | SURFACE POTENTIAL [V] | DISCHARGE SPEED [m/sec] | BIDIRECTIONAL REGISTER ADJUSTMENT CORRECTION VALUE EMPLOYED IN PRINTER 2 [UNITS OF 2400 dpi] | PRINTER 1 | PRINTER 2 |
| | A | 0.1 | 1.2 | −200 | 15.0 | −2 | ▲ | ○ |
| MEDIUM ON WHICH BIDIRECTIONAL REGISTER ADJUSTMENT WAS CARRIED OUT → | B | 0.1 | 1.2 | −500 | 16.5 | 0 | ◎ | ◎ |
| | C | 0.1 | 1.2 | −700 | 17.5 | +1 | ○ | ◎ |

FIG. 12

| TYPE OF PRINTING MEDIUM | THICKNESS [mm] | PAPER DISTANCE [mm] | POWER FEED CONDITION [kV] | HUMIDITY [%] | SURFACE POTENTIAL [kV] |
|---|---|---|---|---|---|
| REFERENCE MEDIUM | 0.1 | 1.2 | −2.0 | 75~100 | −0.2 |
| | 0.1 | 1.2 | −2.0 | 45~75 | −0.5 |
| | 0.1 | 1.2 | −2.0 | 0~45 | −0.7 |
| A | 0.1 | 1.2 | −2.0 | 75~100 | −0.5 |
| | 0.1 | 1.2 | −2.0 | 45~75 | −0.7 |
| | 0.1 | 1.2 | −2.0 | 0~45 | −0.9 |
| B | 0.1 | 1.2 | −2.0 | 75~100 | −0.05 |
| | 0.1 | 1.2 | −2.0 | 45~75 | −0.2 |
| | 0.1 | 1.2 | −2.0 | 0~45 | −0.4 |

FIG. 13

CARRIAGE SPEED ALL 50 [inch/sec]

| TYPE OF PRINTING MEDIUM | THICK-NESS [mm] | PAPER DISTANCE [mm] | POWER FEED CONDITION [kV] | HUMID-ITY [%] | SURFACE POTENTIAL [kV] | DISCHARGE SPEED [m/sec] | X SHIFT AMOUNT FROM REFERENCE [μm] | BIDIREC-TIONAL REGISTER VALUE | BIDIRECTIONAL REGISTER ADJUSTMENT CORRECTION VALUE EMPLOYED IN PRINTER 2 [UNITS OF 2400 dpi] | RESULT OF GRAY PATTERN GRANULAR QUALITY EVALUATION | |
|---|---|---|---|---|---|---|---|---|---|---|---|
| | | | | | | | | | | PRINTER 1 | PRINTER 2 |
| REFERENCE MEDIUM | 0.1 | 1.2 | −2.0 | 50 | −0.5 | 16.5 | 0.0 | 0 | – | ◎ | ◎ |
| A | 0.1 | 1.2 | −2.2 | 50 | −0.7 | 17.5 | 5.2 | 1 | +1 | ○ | ◎ |
| B | 0.1 | 1.2 | −2.0 | 50 | −0.2 | 15.0 | −9.2 | 1 | −2 | ▲ | ○ |
| A | 0.1 | 1.2 | −2.2 | 80 | −0.5 | 16.5 | −0.0 | 1 | 0 | ◎ | ◎ |
| B | 0.1 | 1.2 | −2.0 | 80 | −0.05 | 14.2 | −12.7 | 1 | −3 | ▲ | ◎ |

INKJET PRINTING APPARATUS AND INK DISCHARGE CONTROL METHOD

BACKGROUND OF THE INVENTION

1. Field of the Invention

The present invention relates to an inkjet printing apparatus that performs printing on a printing medium by discharging ink drops from a nozzle of a printing head based on print data, and an ink discharge control method in the inkjet printing apparatus.

2. Description of the Related Art

Recent years have seen an increase in the number of colors, an increase in density, a decrease in the size of drops, and an increase in the number of nozzles in inkjet printing apparatuses in order to meet demand for even higher quality and higher speed than that in commercially available inkjet printing apparatuses. As a result, it has become possible to provide users with photograph images that are in no way inferior to even silver halide photographs in the case of performing printing on special media, in addition to applications for printing web pages and text on normal paper. Meanwhile, inkjet printing apparatuses for business use and industrial use with printing speeds that have been raised to the level of laser beam printers are widely prevalent in the market.

In order to raise the printing speed of such inkjet printing apparatuses for business use and industrial use, it has been common to elongate the nozzles of the printing head. With such inkjet printing apparatuses, it is difficult to maintain a constant distance between the nozzle face of the printing head and the printing medium (hereinafter, referred to as the "paper distance"). This is due to an increase in the distance from the pinch roller that supports the printing medium upstream of the printing head to the paper discharge roller that supports the printing medium downstream of the printing head. Accordingly, an electrostatic adsorption conveyance system has been realized in which, in a printing medium conveying mechanism using an endless belt, a printing medium is adsorbed to the endless belt by generating static electricity on the surface of the belt, and the printing medium is conveyed in this state.

In the inkjet printing apparatus installed in the electrostatic adsorption conveyance system, the adsorbability of the printing medium changes depending on the type of printing medium, usage environment conditions such as humidity, the printing medium conveying speed, soiling of the endless belt, and the like. A rapid change in adsorbability impairs the stability of printing medium conveying in the inkjet printing apparatus.

In order to stably convey a printing medium by adsorption to an endless belt, Japanese Patent Laid-Open No. 2004-262557 discloses that the cycle of the AC (+and −) applied to a power feed roller, which applies static electricity to the endless belt, is controlled depending on the type of printing medium. Also, Japanese Patent Laid-Open No. 2008-110853 discloses that the surface potential of an endless belt is detected, and the voltage applied to a power feeding means for applying static electricity to the endless belt is controlled in accordance with the detection result.

However, although the stable conveying of a printing medium can be realized in such inkjet printing apparatuses, the static electricity applied to the endless belt influences the discharge speed at which ink drops are discharged from the printing head. This results in disrupted landing of ink.

For example, in Japanese Patent Laid-Open No. 2004-262557, in the electric field generated by the charge on the endless belt and the charge on the printing medium, Coulomb's force acts on ink drops discharged from the printing head due to the charge of the ink drops. In other words, the behavior of ink drops discharged from the printing head is determined by the surface potential measured on the printing medium and the charge of the ink drops, and this fact leads to disrupted landing of ink drops.

Also, in Japanese Patent Laid-Open No. 2008-110853, the surface potential is uniformly "0" in the average static charge distribution on the belt directly below the printing head, but in the printing medium conveying direction, the surface potential is microscopically different in the positively charged portion, the negatively charged portion, and the boundary portions thereof. Accordingly, particularly in the case where the speed of the ink drops is low, the landing of ink drops is not constant due to variation in the discharge speed of the ink drops attracted due to the Coulomb's force. As a result, a line (having a pitch equal to half the positive/negative static charge cycle) appears in the portion where the polarity of the static electricity applied to the endless belt by the power feed roller switches between positive and negative.

SUMMARY OF THE INVENTION

An aspect of the present invention is to eliminate the above-mentioned problems with the conventional technology. The present invention provides an inkjet printing apparatus that prevents disrupted landing of ink drops in a configuration for conveying a printing medium by electrostatic adsorption, and an ink discharge control method in the inkjet printing apparatus.

The present invention in its first aspect provides an inkjet printing apparatus for performing printing based on image data by scanning a printing head in a direction that intersects a conveying direction of a printing medium, and discharging ink from the printing head onto the printing medium, comprising: a conveying unit that has a roller that drives an endless belt and a static charge unit that charges the belt, configured to convey the printing medium in the conveying direction by causing the printing medium to adsorb to a surface of the belt by electrostatic force, and causing the belt to be driven by the roller; an acquisition unit configured to acquire a surface potential of the printing medium that has been conveyed to a position directly below the printing head by the conveying unit when printing is performed based on test data by discharging ink from the printing head onto the printing medium; a determination unit configured to obtain a discharge speed of the ink that has been associated in advance with the surface potential acquired by the acquisition unit, and configured to determine an amount of variation in a landing position of the ink on the printing medium based on a scanning speed of the printing head, a distance from the printing head to the printing medium, and the discharge speed of the ink; a correction unit configured to correct a timing according to which the ink is discharged from the printing head so as to cancel out the amount of variation in the landing position determined by the determination unit; and a printing unit configured to perform printing based on the image data by discharging ink from the printing head onto the printing medium in accordance with the timing corrected by the correction unit.

The present invention in its second aspect provides an ink discharge control method executed in an inkjet printing apparatus comprising a conveying unit that has a roller that drives an endless belt and a static charger that charges the belt, and that conveys a printing medium in a conveying direction by causing the printing medium to adsorb to a surface of the belt by electrostatic force, and causing the belt to be driven by the roller, the inkjet printing apparatus performing printing based on image data by scanning a printing head in a direction that intersects the conveying direction of the printing medium, and discharging ink from the printing head onto the printing medium, the ink discharge control method comprising: an acquiring step of acquiring a surface potential of the printing medium that has been conveyed to a position directly below the printing head by the conveying unit when printing is performed based on test data by discharging ink from the printing head onto the printing medium; a determining step of obtaining a discharge speed of the ink that has been associated in advance with the surface potential acquired in the acquiring step, and determining an amount of variation in a landing position of the ink on the printing medium based on a scanning speed of the printing head, a distance from the printing head to the printing medium, and the ejection speed of the ink; a correcting step of correcting a timing according to which the ink is discharged from the printing head so as to cancel out the amount of variation in the landing position determined in the determining step; and a printing step of performing printing based on the image data by discharging ink from the printing head onto the printing medium in accordance with the timing corrected in the correcting step.

According to the present invention, disrupted landing of ink drops can be prevented even in the case of conveying a printing medium by electrostatic adsorption.

Further features of the present invention will become apparent from the following description of exemplary embodiments with reference to the attached drawings.

BRIEF DESCRIPTION OF THE DRAWINGS

FIG. 7 is a diagram showing a relationship between surface potential and discharge speed.

FIG. 9 is a diagram showing granular quality results for three types of printing media.

FIG. 12 is a diagram showing a relationship between printing medium type, power feed condition, humidity, and surface potential.

FIG. 13 is a diagram showing granular quality results for various printing media.

DESCRIPTION OF THE EMBODIMENTS

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that constituent elements that are the same have been given the same reference signs, and redundant descriptions thereof will not be given.

First Embodiment

It should be noted that in the following description, "printing" is a concept not only referring to the formation of significant information such as characters and graphics, but also broadly referring to the formation of images, patterns, and the like on a printing medium, as well as the manipulation of a medium, regardless of whether the recorded content is significant or insignificant, and regardless of whether the recorded content has been made explicit so as to be visually perceivable by a human.

Also, "printing medium" is a concept not only referring to paper used in a general printing apparatus, but also broadly referring to any ink receptive material such a cloth, a plastic film, a metal plate, glass, ceramics, wood, and leather.

Furthermore, "ink" (also referred to as "liquid") is intended to be broadly interpreted similarly to the definition of "printing" ("printing"), and refers to a liquid that can contribute to the formation of an image, a pattern, or the like or the manipulation of a printing medium by being provided on a printing medium, or can contribute to ink processing (e.g., coagulation or insolubilization of a colorant in ink to be provided on a printing medium).

Moreover, unless mentioned otherwise, "nozzle" collectively refers to a discharge opening, fluid channels in communication therewith, and elements generating energy used in ink discharge.

Figure 1:
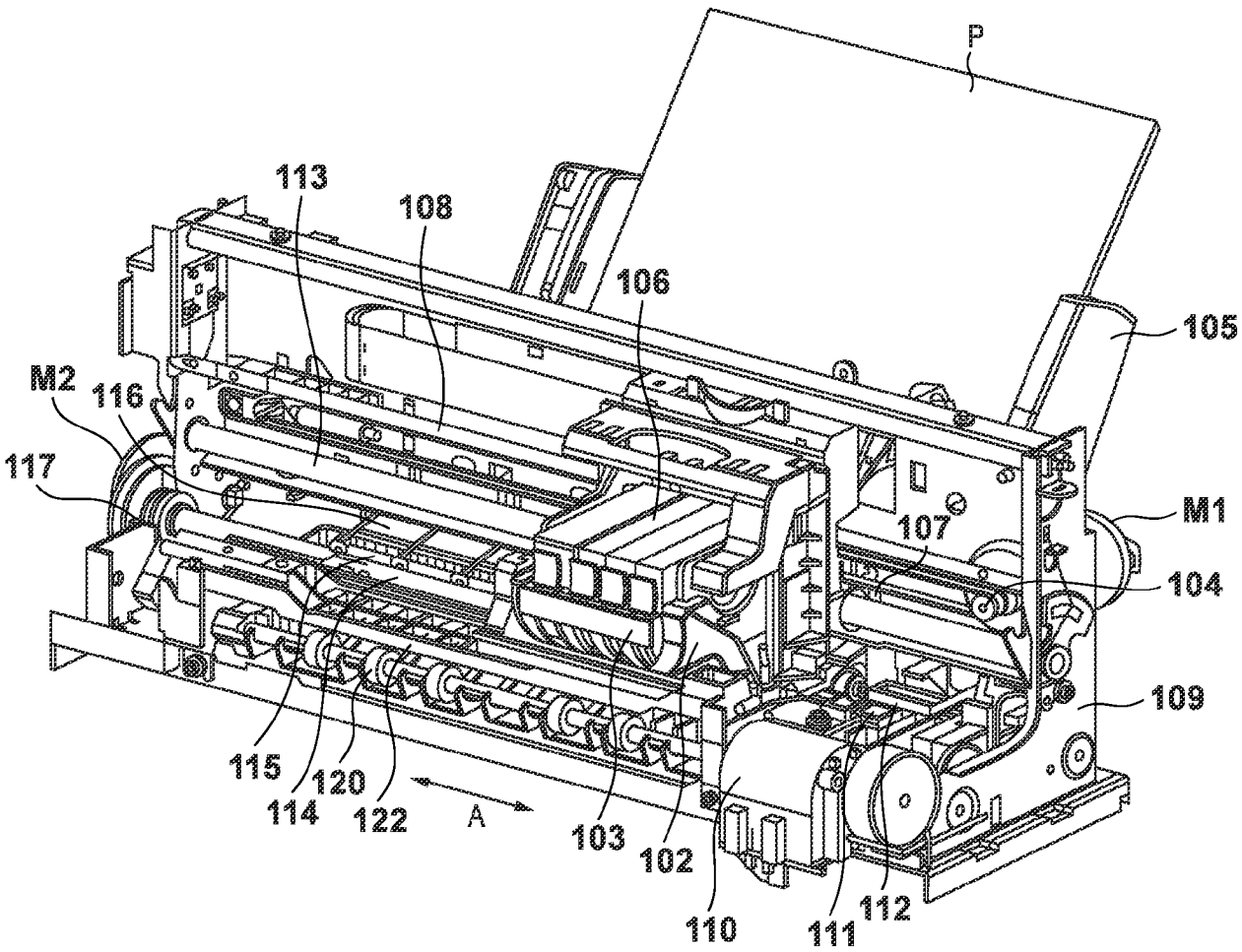
FIG. 1 is an exterior perspective diagram showing an overview of a configuration of an inkjet printing apparatus.

Description of Inkjet Printing Apparatus (FIG. 1)

FIG. 1 is an exterior perspective diagram showing an overview of a configuration of an inkjet printing apparatus according to the present embodiment.

As shown in FIG. 1, an inkjet printing apparatus 100 (also simply referred to as "printing apparatus") performs printing by using a transmission mechanism 104 to transmit drive force generated by a carriage motor M1 to a carriage 102, in which a printing head 103 that performs printing by discharging ink in accordance with an inkjet system is installed, thus causing the carriage 102 to move back and forth in the arrow A direction, and also feeding a printing medium P such as a piece of printing paper via a paper feed mechanism 105, conveying the printing medium P to a printing position, and discharging ink from the printing head 103 onto the printing medium P at the printing position.

Also, in order to keep the printing head 103 in a favorable state, the carriage 102 is moved to the position of a restoration apparatus 110 and discharge restoration processing is performed on the printing head 103 intermittently.

Not only is the printing head 103 installed in the carriage 102 of the printing apparatus 100, but also ink cartridges 106 storing ink to be supplied to the printing head 103 are mounted in the carriage 102. The ink cartridges 106 can be mounted in and detached from the carriage 102.

The printing apparatus 100 shown in FIG. 1 can perform color printing, and in order to achieve this, four ink cartridges respectively housing magenta (M), cyan (C), yellow (Y), and black (K) ink are mounted in the carriage 102. These four ink cartridges can be independently mounted and detached.

The carriage 102 and the printing head 103 are configured such that the junction faces thereof are appropriately in contact with each other and a necessary electrical connection can be established and maintained. The printing head 103 performs printing by selectively discharging ink from multiple discharge openings by applying energy in accordance with a printing signal. Specifically, the printing head 103 of the present embodiment adopts an inkjet system for discharging ink using thermal energy, and includes electrothermal converters for generating thermal energy. Electrical energy applied to the electrothermal converters is converted into thermal energy, air bubbles grow and shrink due to film boiling resulting from ink being subjected to the thermal energy, and ink is discharged from the discharge openings using pressure change resulting from the growing and shrinking. The electrothermal converters are provided in one-to-one correspondence with the discharge openings, and pulse voltages are applied to electrothermal converters in accordance with a printing signal so as to discharge ink from corresponding discharge openings.

As shown in FIG. 1, the carriage 102 is joined to part of a drive belt 107 of the transmission mechanism 104 that transmits drive force of the carriage motor M1, and the carriage 102 is guided and supported so as to be able to slide along a guide shaft 113 in the arrow A direction. Accordingly, the carriage 102 moves back and forth along the guide shaft 113 due to forward rotation and reverse rotation of the carriage motor M1. The printing apparatus 100 also includes a scale 108 for indicating the absolute position of the carriage 102 along the traveling direction of the carriage 102 (arrow A direction). In the present embodiment, the scale 108 is a transparent PET film on which black bars have been printed with a necessary pitch, one end of the scale 108 being fixed to a chassis 109, and the other end being supported by a plate spring (not shown).

The printing apparatus 100 is also provided with a platen (not shown) opposing the discharge opening face in which the discharge openings (not shown) of the printing head 103 are formed, and printing is performed over the entire width of the printing medium P conveyed onto the platen by discharging ink in accordance with a printing signal transmitted to the printing head 103 while at the same time using drive force from the carriage motor M1 to cause back and forth movement of the carriage 102 in which the printing head 103 is installed.

Furthermore, in FIG. 1, reference numeral 114 denotes a conveying roller that is driven by a conveying motor M2 for conveying the printing medium P, reference numeral 115 denotes a pinch roller that brings the printing medium P into contact with the conveying roller 114 using a spring (not shown), reference numeral 116 denotes a pinch roller holder that rotatably supports the pinch roller 115, and reference numeral 117 denotes a conveying roller gear that is fixed to one end of the conveying roller 114. The conveying roller 114 is driven by rotation of the conveying motor M2 that is transmitted to the conveying roller gear 117 via an intermediate gear (not shown).

Furthermore, reference numeral 120 denotes discharge rollers for discharging the printing medium P to the outside of the printing apparatus after an image has been formed thereon by the printing head 103, and the discharge rollers 120 are configured so as to be driven by rotation transmitted from the conveying motor M2. Note that the discharge rollers 120 are brought into contact with the printing medium P by a spur roller (not shown) that is pressed against by a spring (not shown). Reference numeral 122 denotes a spur holder that rotatably supports the spur roller.

As shown in FIG. 1, the restoration apparatus 110 for correcting a discharge defect of the printing head 103 is disposed in the printing apparatus 100 at a desired position (e.g., a position corresponding to home position) outside the range of back and forth movement for the printing operation performed by the carriage 102 in which the printing head 103 is installed.

The restoration apparatus 110 includes a capping mechanism 111 for capping the discharge opening face of the printing head 103 and a wiping mechanism 112 for cleaning the discharge opening face of the printing head 103, and the restoration apparatus 110 performs discharge restoration processing in which, for example, air bubbles, ink having an increased viscosity, and the like in the ink fluid channels of the printing head 103 are eliminated by forcibly expelling ink from the discharge openings using a suction configuration (suction pump or the like) in the restoration apparatus in coordination with the capping of the discharge opening face by the capping mechanism 111.

Also, capping the discharge opening face of the printing head 103 using the capping mechanism 111 enables protecting the printing head 103 as well as preventing evaporation and drying of the ink. Also, the wiping mechanism 112 is arranged in the vicinity of the capping mechanism 111 and wipes away ink drops that are attached to the discharge opening face of the printing head 103.

The capping mechanism 111 and the wiping mechanism 112 enable maintaining a normal ink discharge state in the printing head 103.

Figure 2:
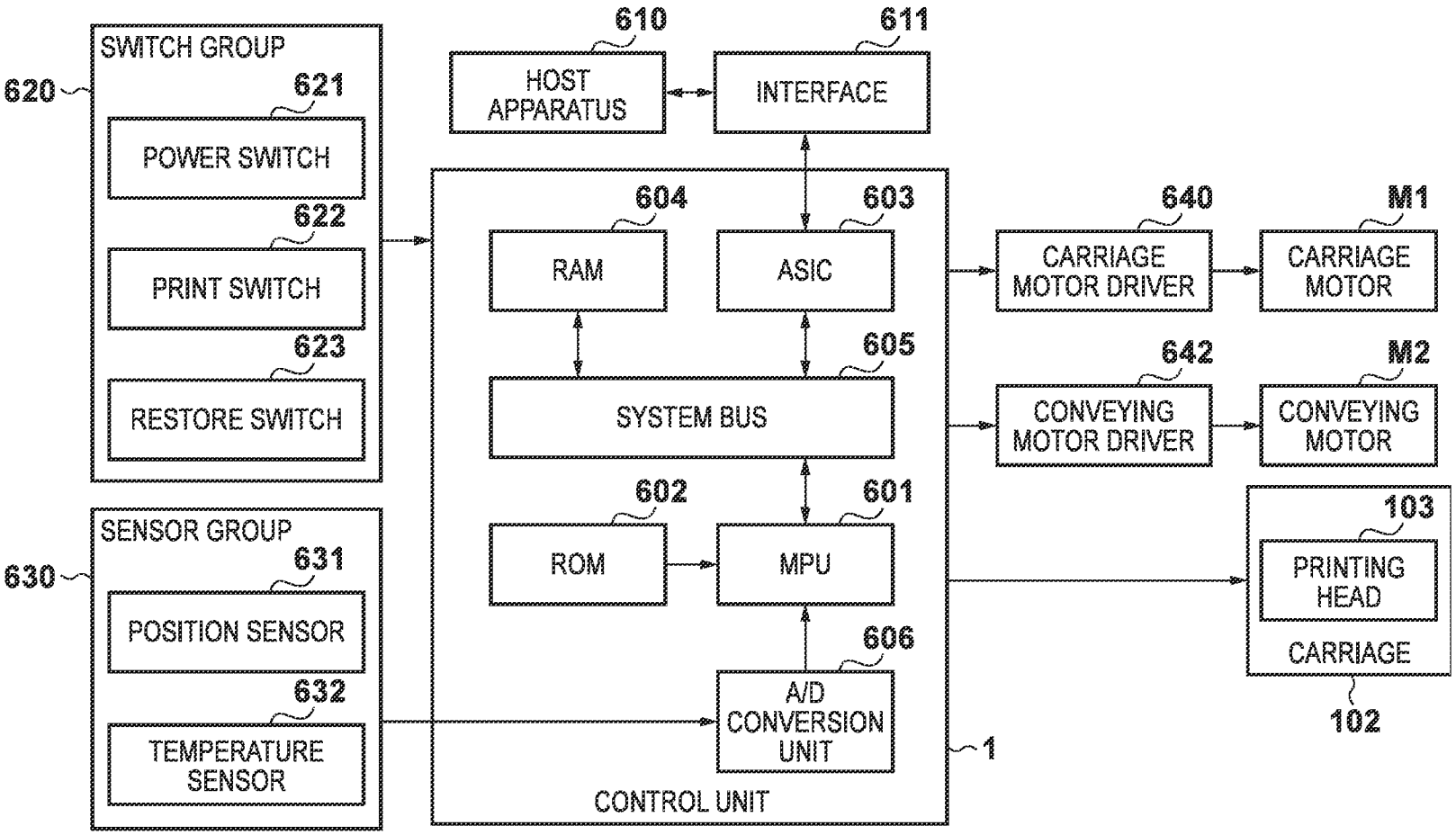
FIG. 2 is a block diagram showing a control configuration of the inkjet printing apparatus.

Control Configuration of Inkjet Printing Apparatus (FIG. 2)

FIG. 2 is a block diagram showing a control configuration of the printing apparatus shown in FIG. 1. As shown in FIG. 2, a control unit 1 is configured by: an MPU 601; a ROM 602 storing a program corresponding to a later-described control sequence, necessary tables, and other fixed data; an application-specific integrated circuit (ASIC) 603 that generates control signals for control of the carriage motor M1, control of the conveying motor M2, and control of the printing head 103; a RAM 604 provided with an image data development area, a work area for program execution, and the like; a system bus 605 that connects the MPU 601, the ASIC 603, and the RAM 604 to each other and performs the exchange of data; an A/D converter 606 that receives an input of analog signals from a below-described sensor group, performs A/D conversion on the analog signals, and supplies the resulting digital signals to the MPU 601; and the like. The control unit 1 also executes the various types of processing shown in later-described control sequences (flowcharts).

Also, reference numeral 610 in FIG. 2 denotes a computer (or an image reader, a digital camera, or the like) that is the image data supply source, and this computer is generically referred as the "host apparatus". Image data, commands, status signals, and the like are transmitted and received between the host apparatus 610 and the printing apparatus 100 via an interface (I/F) 611.

Furthermore, reference numeral 620 denotes a switch group configured from switches for receiving commands input by an operator, such as a power switch 621, a print switch 622 for instructing the start of printing, and a restore switch 623 for instructing the startup of processing for maintaining the ink discharge performance of the printing head 103 in a favorable state (restoration processing). Reference numeral 630 denotes a sensor group for detecting apparatus states, and the sensor group 630 is configured from, for example, a position sensor 631 such as a photocoupler for detecting a home position h, and a temperature sensor 632 provided in an appropriate location in the printing apparatus for detecting the environmental temperature.

Moreover, reference numeral 640 denotes a carriage motor driver that drives the carriage motor M1 for scanning the carriage 102 back and forth in the arrow A direction, and reference numeral 642 denotes a conveying motor driver that drives the conveying motor M2 for conveying the printing medium P.

When the printing head 103 is scanned and performs printing, the ASIC 603 transfers drive data (DATA) for driving printing elements (discharge heaters) to the printing head while directly accessing the storage area of the ROM 602.

Note that although the configuration shown in FIG. 1 is a configuration in which the ink cartridges 106 and the printing head 103 can be separated, the ink cartridges 106 and the printing head 103 may be formed integrally so as to configure a replaceable head cartridge.

Furthermore, although the present and following embodiments are described assuming that the droplets discharged from the printing head are ink, and the liquid housed in the ink tanks is ink, the housed content is not limited to be ink. For example, a processing liquid discharged onto the printing medium in order to raise the fixability and water resistance of a recorded image as well as raise the image quality thereof may be housed in the ink tanks.

In the present and following embodiments, high-density and high-resolution printing can be achieved by using, particularly among inkjet printing systems, a system that includes a configuration (e.g., an electrothermal converter or a laser beam) for generating thermal energy as energy utilized for performing ink discharge, and that causes a change in ink state using the thermal energy.

Furthermore, as the full-line type of printing head whose length can accommodate the width of the widest printing medium on which the printing apparatus can perform printing, it is possible to use either a configuration in which that length is achieved by a combination of multiple printing heads as described above in this description, or a configuration in which the printing head is a single integrally-formed printing head.

Additionally, there is no limitation to a cartridge type of printing head in which ink tanks are integrally provided in the printing head itself as described above in the present embodiment, and it is possible to use a replaceable chip type of printing head that, by being mounted in the apparatus body, can be electrically connected to the apparatus body and receive a supply of ink from the apparatus body.

Moreover, as the mode of the printing apparatus in the present embodiment, the printing apparatus may be provided separately or integrally as an image output terminal for an information processing device such as a computer, as well as may take the mode of a reproduction apparatus in which the printing apparatus is integrated with a reader or the like, or may take the mode of a facsimile apparatus having a transmission/reception function.

Configuration of Conveying Portion in Inkjet Printing Apparatus

Figure 3:
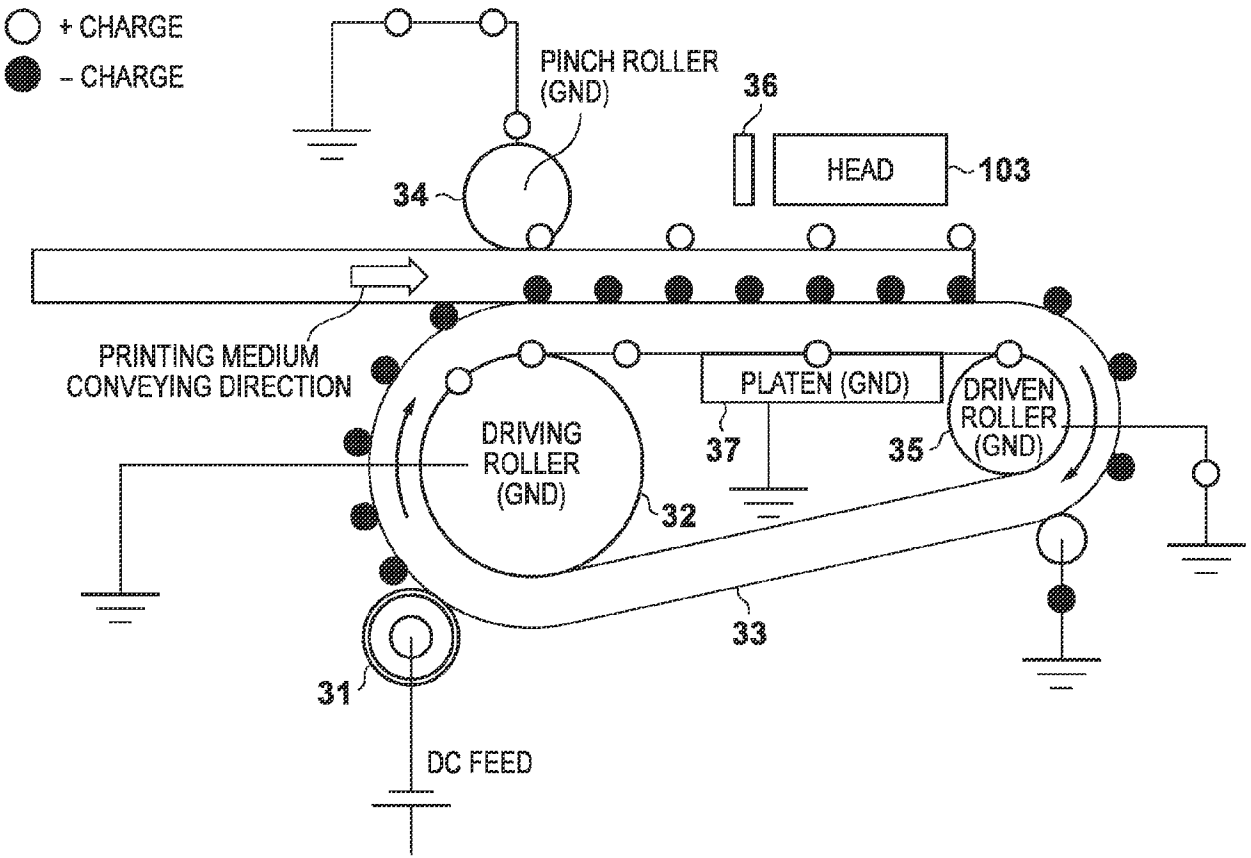
FIG. 3 is a diagram showing a configuration of a printing medium conveying portion of an inkjet printing apparatus according a first embodiment.

FIG. 3 is a diagram showing a configuration of a printing medium conveying portion in the inkjet printing apparatus 100. In the present embodiment, the printing medium adsorbs to an endless belt by electrostatic force, and is conveyed in this state. Also, FIG. 3 is a schematic cross-sectional diagram taken along the scanning direction of the carriage in which the printing head is installed. The carriage is scanned in a direction that intersects the conveying direction of the printing medium, which is from the foreground to the background in FIG. 3. The conveying portion is configured such that the printing medium moves from the left side in FIG. 3 to the right side directly below the printing head as the endless belt makes one full rotation.

When a −2 kV voltage was applied from the power feed roller 31 functioning as a static charge unit to the endless belt, the surface potential of the endless belt 33 was measured to be −1.5 kV downstream of the power feed roller 31, directly above a grounded driving roller 32. It can be understood from this result that, as shown in FIG. 3, a negative charge moves from the power feed roller 31 so as to be present on the surface of the endless belt 33. Thereafter, the printing medium moves on the endless belt 33 while being sandwiched between the endless belt 33 and the grounded pinch roller 34. At this time, the grounded pinch roller 34 gathers a charge whose polarity is the opposite of that of the charge on the surface of the endless belt 33 from GND, and this charge whose polarity is the opposite of that of the charge on the surface of the endless belt 33 is applied to the surface of the printing medium. As shown in FIG. 3, since the charge on the endless belt 33 is negative, the charge on the surface of the printing medium is positive, which is the opposite polarity.

When the printing medium is on the endless belt 33, the negative charge on the endless belt 33 is on the non-printing surface, and the positive charge is on the printing surface, and therefore the printing medium and the endless belt 33 electrostatically adsorb to each other due to the Coulomb's force of attraction between the charges. The printing medium adsorbed to the endless belt 33 moves to a position directly below the printing head due to the rotation of the driving roller 32, and printing is performed. At this time, the surface potential directly below the printing head is determined substantially by the charge on the inner side of the endless belt 33, the charge on the outer side of the endless belt 33, and the charge on the printing medium. In order to detect this surface potential, in the present embodiment, a surface potential measuring device 36 is provided at a position immediately before the printing medium begins to pass the printing head. The position at which the surface potential measuring device 36 is provided is not particularly limited, and may be, for example, a position in the vicinity of the printing head (e.g., the nozzle position), as long as it is a position at which the surface potential directly below the printing head can be detected. Also, a configuration is possible in which a platen 37 supporting the endless belt 33 is grounded to GND, and the surface potential of the endless belt is cancelled after half-rotation.

Ink Drop Static Charge and Discharge Speed

Figure 4A:
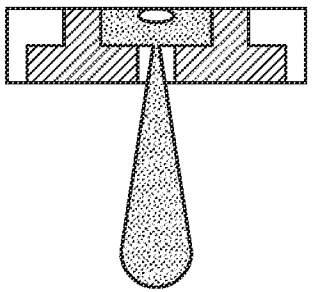
FIGS. 4A, 4B, and 4C are diagrams illustrating static charge of discharged ink drops.
Figure 4B:
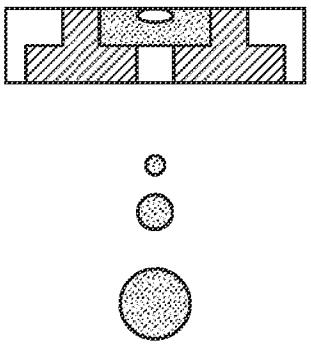
Figure 4C:
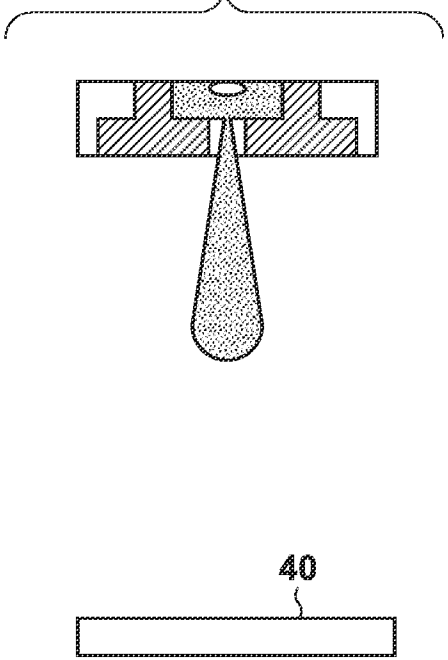

The following describes the static charge of ink drops discharged from the nozzles of the printing head. FIGS. 4A to 4C are schematic diagrams showing ink drops discharged from a nozzle of the printing head. As shown in FIGS. 4A to 4C, ink is discharged in the perpendicular downward direction. As shown in FIG. 4A, ink is pushed out forward from the nozzle at a bubble formation timing. Thereafter, as shown in FIG. 4B, drops are formed due to the effect of ink viscosity and surface tension. In addition to the large main drop, multiple minute ink drops (first satellite, second satellite, and so on) are formed.

Next is a description of how the discharged ink drops behave due to the surface potential directly below them. As shown in FIG. 4C, a flat-plate electrode 40 was placed parallel with the discharge opening of the nozzle at a position approximately 2.0 mm away from the discharge opening in opposition to the ink drops, and in this state, change in the ink drop discharge speed in the vicinity of a distance of 1.0 mm from the discharge opening was examined. The ink used here was pigment-based cyan ink. The discharge opening face and the discharge opening element were connected to 0 kV (GND), and voltages successively raised by 0.5 kV from −1.5 kV to +1.5 kV were applied to the parallel electrode.

Figure 5:
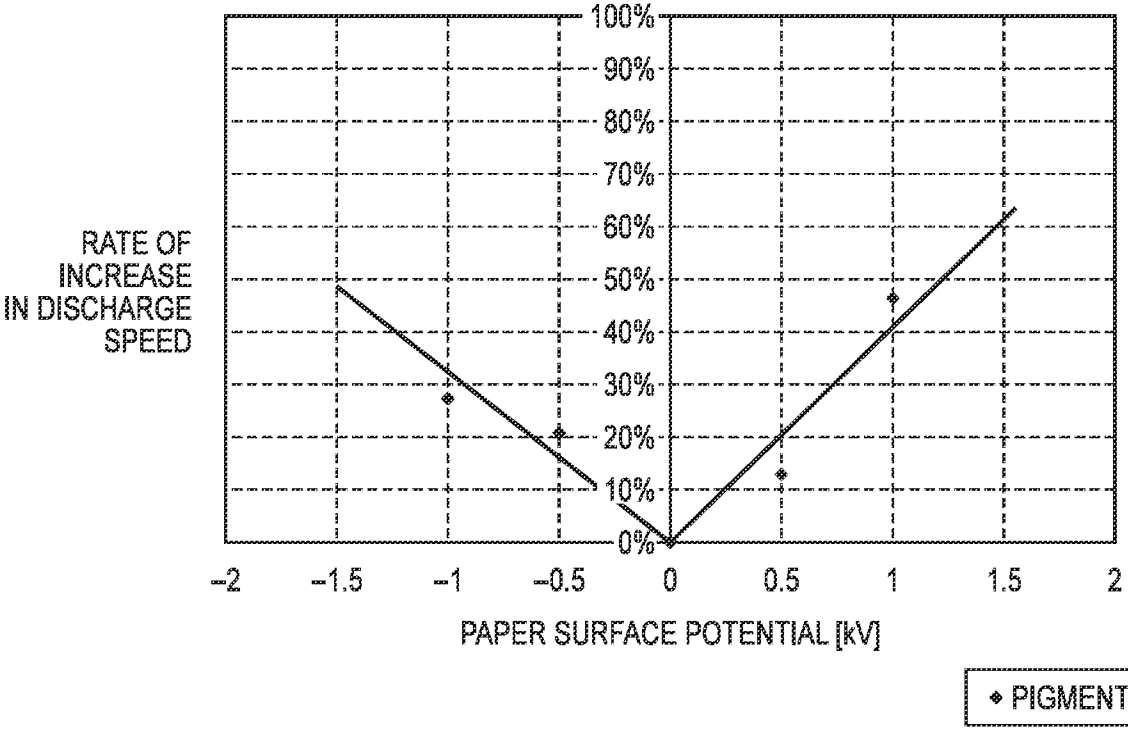
FIG. 5 is a diagram showing change in ink drop discharge speed with respect to surface potential.

The obtained results are shown in FIG. 5. The horizontal axis indicates the surface potential of the flat-plate electrode 40, and the vertical axis indicates the rate of change in ink drop discharge speed measured corresponding to the surface potential that changes according to the applied voltage, with 100% being the discharge speed when the surface potential of the flat-plate electrode 40 is 0 kV. Here, the discharge speed when the surface potential of the flat-plate electrode 40 was 0 kV was 14 [m/sec] for the main drop.

As shown in FIG. 5, the discharge speed of the main drop increases regardless of the polarity (+or −) of the surface potential of the flat-plate electrode 40. Also, when linear approximation was applied, it was found that the speed increased by approximately 20% with respect to ΔV=0.5 kV on the + side, and the speed increased by approximately 18% with respect to ΔV=0.5 kV on the − side. Although not shown, it was found that similarly to the main drop, the discharge speed of the first satellite that lands on the printing medium increases regardless of the polarity (+or −) of the surface potential. The rate of this speed increase followed substantially the same trend as the main drop. The following can be inferred from the result that the discharge speed of the main drop and the first satellite that land on the printing medium increases when the external electric field is +and when the external electric field is −. Specifically, when an ink drop is formed, the polarity of the initial charge of the ink drop is the opposite of that of the external electric field, thereafter Coulomb's force (F=qE, where q is the charge and E is the electric field) acts on the ink drop due to the external electric field, and the ink drop is attracted to the flat-plate electrode 40 such that the flight speed of the ink drop increases (i.e., the speed increases in the discharge direction).

As described above, it was found that the discharge speed of the ink drop discharged from the nozzle of the printing head changes according to the surface potential directly below the printing head.

Connection between surface potential and bidirectional registration adjustment correction value As described above, the discharge speed of an ink drop discharged from the printing head changes according to the surface potential on the printing medium adsorbed to the endless belt directly below the printing head. In a serial type of inkjet printing apparatus, change in the ink drop discharge speed leads to the image fault of bidirectional registration mismatching.

The following describes the bidirectional registration. When one ruling line extending in the conveying direction is formed as image, the ruling line is completed by scanning the carriage in the outbound direction and the inbound direction for the ink drops discharged from the same nozzle. Here, the bidirectional registration is for discharge timing control for completing a good-looking ruling line by adjusting the discharge timing for both scanning directions (outbound and inbound). Conventionally, the ink drop discharge speed is set constant, and bidirectional registration adjustment is carried out by printing test ruling line patterns and test patch patterns in the outbound and inbound directions of the carriage in accordance with the carriage travelling speed, which serves as a reference, and the paper distance, which is the distance from the discharge opening portion of the printing head to the printing medium.

For example, conventionally, when bidirectional registration adjustment is performed, the paper distance, which fluctuates depending on the thickness of various types of paper media, is estimated based on, for example, the printing mode designated by the user, and the bidirectional registration adjustment correction value that has been associated in advance with the designated printing mode is determined. The bidirectional registration adjustment correction value is then reflected in the discharge direction discharge timing for the outbound direction and the inbound direction.

Figure 6A:
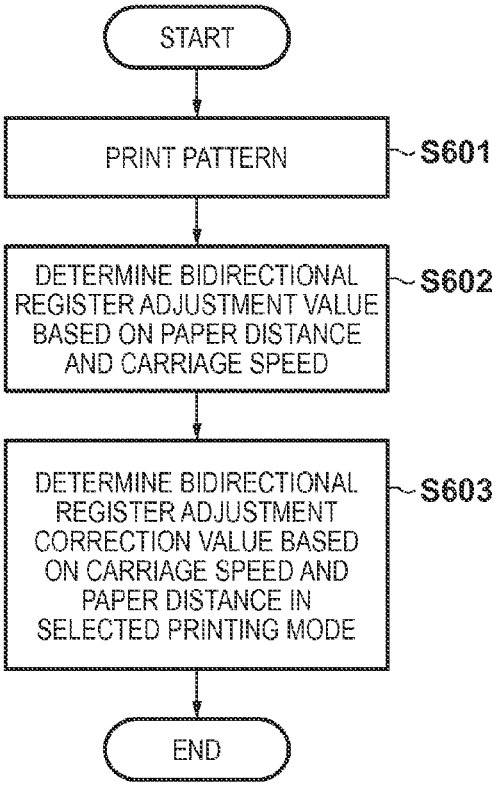
FIGS. 6A and 6B are flowcharts showing a procedure of bidirectional registration adjustment value correction according to the first embodiment.

FIG. 6A is a flowchart showing an example of a conventional procedure of bidirectional registration adjustment processing. Conventionally, first, test data indicating a color pattern or the like is printed (S601). A bidirectional registration adjustment value is determined based on the paper distance and the carriage speed (scanning speed) at the time when the color pattern was printed (S602). Next, a bidirectional registration adjustment correction value is determined based on the carriage speed and the paper distance that is obtained based on the difference from the reference printing medium thickness of the printing medium to be used in the printing mode selected by the user (S603).

In this way, in a conventional bidirectional registration adjustment method, the bidirectional registration adjustment correction value is determined based on, for example, the paper distance and the carriage speed. In other words, no consideration whatsoever is given to change in the ink drop discharge speed, which changes according to the surface potential on the printing medium directly below the printing head. As a result, even with a bidirectional registration adjustment correction value determined using the conventional method, bidirectional registration adjustment is not performed appropriately, and the landing position becomes misaligned, thus leading to an image fault. For example, assume that the surface potential on the printing medium is −500 V in processing for printing a registration adjustment pattern that is to serve as a reference. With the conventional bidirectional registration adjustment method, assuming that the surface potential on the printing medium is −1000 V in the case of performing printing on a different type of printing medium having the same thickness, even if the carriage travelling speed is the same as that in the case of −500 V, the discharge speed actually increases to a certain extent due to the influence of the surface potential on the printing medium on the endless belt 33, and therefore bidirectional registration adjustment cannot be appropriately performed using the determined bidirectional registration adjustment correction value.

Figure 6B:
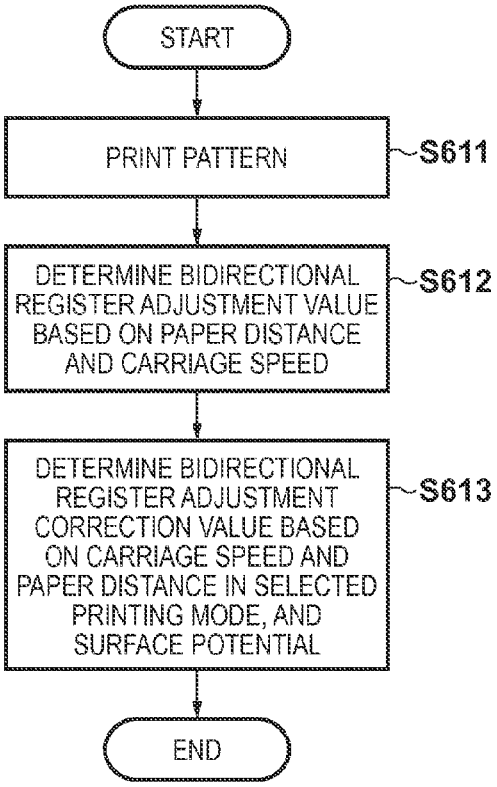

In view of this, in the present embodiment, the inkjet printing apparatus includes a configuration in which the surface potential on the printing medium adsorbed to the endless belt 33 directly below the printing head can be detected by the surface potential measuring device 36, as shown in FIG. 3. Then, as shown in FIG. 6B, the processing of S611 and S612, which is similar to that of the conventional procedure, is performed, and thereafter in processing for determining a bidirectional registration adjustment correction value (S613), the surface potential measuring device 36 detects the surface potential, and a bidirectional registration adjustment correction value is determined in accordance with the detected surface potential, along with the carriage speed and the paper distance.

Figure 8:
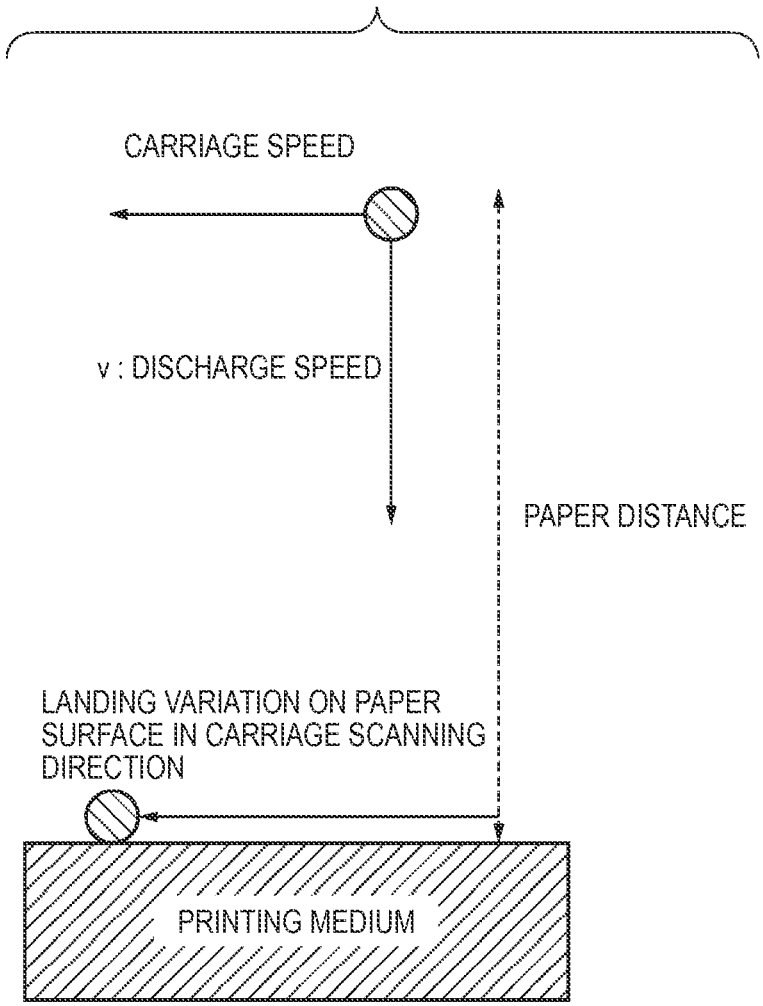
FIG. 8 is a diagram illustrating the calculation of landing variation.

Specific numerical value of and appropriateness of registration adjustment correction value The following describes the processing for determining a bidirectional registration adjustment correction value based on the surface potential on the printing medium. FIG. 7 is a diagram showing discharge speeds corresponding to various printing medium surface potentials, namely 0 V, −500 V and −1000 V. The discharge speed is obtained by referencing FIG. 5 based on the printing medium surface potential. FIG. 7 furthermore shows landing variation on the printing medium for the carriage scanning direction, with the paper distance from the printing head to the printing medium surface being constant at 1.2 [mm], and the carriage speed being constant at 50 [inch/sec]. The landing variation is the distance from the landing position of ink discharged while the carriage is stopped to the landing position of ink discharged at the same position while the carriage is being scanned. The landing variation on the printing medium for the carriage scanning direction is calculated as shown in FIG. 8, using Expression (1) below.

$$\text{landing variation} = \text{carriage speed} \times \text{paper distance} \div \text{discharge speed} \quad (1)$$

Here, "paper distance÷discharge speed" is the time from when ink is discharged until it lands on the printing medium. Since the ink has the same speed component as the scanning speed of the carriage in the scanning direction, landing variation can be obtained by multiplying the carriage speed by the time taken to land.

In FIG. 7, "X shift amount from reference" indicates how much the landing variation changed when the printing medium surface potential changed, relative to the landing variation for when the printing medium surface potential is −500 V. A bidirectional registration adjustment pattern is printed while the printing medium surface potential is −500 V, and the landing variation on the printing medium for the carriage scanning direction at that time is used as the reference. In FIG. 7, "X shift amount from reference" indicates the shift amount X (corresponding to a specific numerical value for the registration adjustment correction value), which is the X-direction landing position difference from the reference when the printing medium surface potential is 0 V and when the printing medium surface potential is −1000 V. When the printing medium surface potential is 0 V, the shift amount X is −16.5 [μm], and when the printing medium surface potential is −1000 V, the shift amount X is +12.15 [μm]. Since X-direction shift amount values are added in both the outbound and inbound directions when performing bidirectional registration adjustment, the shift amount is double on the printing medium if a ruling line is printed in both the outbound direction and the inbound direction.

With an apparatus capable of correcting the discharge timing in units of 2400 dpi, the landing position can be corrected in units of 10.6 [μm] dot pitch. Letting each shift amount X represent a bidirectional registration adjustment correction value (a value for correcting outbound and inbound shift by correcting shift in either one of the outbound path and the inbound path of the carriage and not the other), the shift amount X is −16.5×2÷10.6=−3.1 at 0 V, and thus is −3 units (3 dots worth). Also, the shift amount X is 12.15×2÷10.6=2.3 at −1000 V, and thus is +2 units (2.3 dots worth). Here, "−" represents the direction of becoming earlier than the original discharge timing, letting the discharge timing at −500 V be 0, and conversely, "+" represents the direction of becoming later than the original discharge timing.

In the present embodiment, first a bidirectional registration adjustment value is determined by printing a reference registration adjustment pattern with the surface potential on the printing medium being −500 V. It is assumed that when the surface potential is changed to 0 V and −1000 V, the paper distance and carriage speed are the same conditions as those used when printing the reference registration adjustment pattern (i.e., when the surface potential is −500 V). If the surface potential measuring device 36 has detected that the surface potential on the printing medium is 0 V, the bidirectional registration adjustment correction value is determined such that the discharge timing is shifted by 2400 dpi×3 units (corresponding to approximately 8.3×3 μsec) in the direction of becoming earlier than the original discharge timing. When 2400-dpi discharge is performed with a carriage speed of 50 [inch/sec], the discharge interval is 1 (2400×50)=8.3 [μsec], and therefore the discharge timing is set earlier by 8.3×3=24.9 [μsec] in either the carriage outbound path or inbound path. As a result, bidirectional shift in the carriage scanning direction is corrected. Similarly, if the surface potential measuring device 36 has detected that the surface potential on the printing medium is −1000 V, the bidirectional registration adjustment correction value is determined such that the discharge timing is shifted by 2400 dpi×2 units (corresponding to approximately 8.3×2 μsec) in the direction of becoming later than the original discharge timing. Ink discharge control is performed in accordance with this bidirectional registration adjustment correction value, and consequently bidirectional shift in the carriage scanning direction is corrected.

Specifically, assuming that the paper distance and the carriage speed are constant regardless of the surface potential on the printing medium, if the absolute value of the surface potential on the printing medium detected by the surface potential measuring device 36 is greater than that when the reference registration adjustment pattern was printed (i.e., if the surface potential was detected to be "−1000 V" in the above-described example), a bidirectional registration adjustment correction value for correction in the direction of becoming later than the original discharge timing is determined, and the ink drop landing position is corrected. On the other hand, if the absolute value of the surface potential on the printing medium detected by the surface potential measuring device 36 is less than that when the reference registration adjustment pattern was printed (i.e., if the surface potential was detected to be "0 V" in the above-described example), a bidirectional registration adjustment correction value for correction in the direction of becoming earlier than the original discharge timing is determined, and the ink drop landing position is corrected.

Note that although the discharge timing of only either the carriage outbound path or inbound path is corrected in the present embodiment, the discharge timing may be corrected for both the outbound path and the inbound path. The correction value in this case is half of the correction value described above.

Effects

The following describes the effects obtained by the configuration for detecting the surface potential on the printing medium on the endless belt 33 directly below the printing head and reflecting the surface potential as a bidirectional registration adjustment correction value. In an inkjet printing apparatus having a configuration such as that shown in FIG. 3, granular quality was evaluated after printing a gray pattern through 4-pass multi-pass printing using three types of printing media A to C that have the same thickness but are made of different materials. FIG. 9 is a diagram showing granular quality results obtained when the gray pattern was printed on the three types of printing media.

A printer 1 shown in FIG. 9 is a conventional inkjet printing apparatus. In other words, the surface potential measuring device 36 was not provided. Also, the bidirectional registration adjustment correction value that was used was determined based on the carriage speed and the paper distance for the three types of printing media (i.e., was determined using a conventional method). A printer 2 shown in FIG. 9 is the inkjet printing apparatus according to the present embodiment. In other words, the surface potential measuring device 36 was provided. For both the printer 1 and the printer 2, bidirectional registration adjustment that was to serve as a reference was performed for the printing medium B.

As shown in FIG. 9, with the printer 1, a smooth image having no granular quality was obtained only on the printing medium B on which bidirectional registration adjustment was carried out, and a rough image with a large amount of granular quality was obtained on the printing medium A. This was due to the fact that, since the printing medium material was different from that of the printing medium B, compared to the printing medium B on which registration adjustment was performed, the state of the charge on the printing medium on the endless belt 33 was different (it is presumed that a large amount of positive charge was present), and the surface potential on the printing medium was largely different. As a result, the ink drop discharge speed changed greatly from that of the case of the printing medium B, landing position shift occurred, and bidirectional registration shift occurred. Degradation in the granular quality of the printing medium C was less than that of the printing medium A. One factor for this is presumed to be the fact that, based on the relationship between the discharge speed and the surface potential of the printing medium B serving as a reference, the change in ink drop discharge speed was less than that of the printing medium A. Specifically, even with printing media having the same thickness, the surface potential on the printing medium on the endless belt 33 directly below the printing head differs, and the ink drop discharge speed varies for the three types of printing media, and as a result, it can be understood that differences will appear in the granular quality of the output images.

On the other hand, with the printer 2 having the surface potential measuring device 36 for detecting the surface potential on the printing medium on the endless belt 33, substantially the same smooth gray image having no granular quality was output for each of the three types of printing media. This is due to the fact that, even if the surface potential on the printing medium on the endless belt 33 directly below the printing head differs for the three types of printing media similarly to the printer 1, the resulting landing shift corresponding to the ink drop discharge speed is properly corrected using the discharge timing.

As a result of the above, it was shown that the above-described effects were obtained by the configuration for detecting the surface potential on the printing medium on the endless belt 33 directly below the printing head and reflecting the surface potential as a bidirectional registration adjustment correction value.

In the present embodiment, a two-layer belt (printing medium adsorption surface side: 1×10^15 [Ωcm] or greater, and printing medium non-adsorption surface side: 1×10^7 [Ωcm] or greater) is used as the endless belt 33. However, a single-layer belt may be used, and in this case, the printing medium is adsorbed to the endless belt 33 using substantially the same principle as in the case of the two-layer belt. Also, although the voltage applied from the power feed roller 31 to the endless belt 33 has a negative polarity as shown in FIG. 3, this voltage may have a positive polarity. As shown in FIG. 5, since the ink drop discharge speed changes according to the surface potential on the printing medium on the endless belt 33, even in the case where a positive polarity voltage is applied, it is possible to determine a bidirectional registration adjustment correction value with respect to the surface potential on the printing medium.

Although the surface potential on the printing medium is acquired by the surface potential measuring device 36 in the present embodiment, a configuration is possible in which, for example, the surface potential is obtained based on a condition of power feeding from the power feed roller 31 to the belt 33 and the type of printing medium. Also, a configuration is possible in which a table associating such values and surface potentials is stored in advance in a storage unit or the like, and a surface potential is acquired based on the power feed condition and the type of printing medium to be used in the bidirectional registration adjustment processing.

As described above, in the present embodiment, a DC static charge is applied to the endless belt 33, the surface potential on the printing medium on the endless belt 33 is detected, and a bidirectional registration adjustment correction value is selected in accordance with the detection result. The timing of ink drop discharging is then controlled using the selected bidirectional registration adjustment correction value, thus correcting landing shift corresponding to change in discharging speed, which changes according to the surface potential on the printing medium. As a result, it is possible to prevent image degradation occurring due to misalignment in bidirectional registration adjustment.

Second Embodiment

Figure 10:
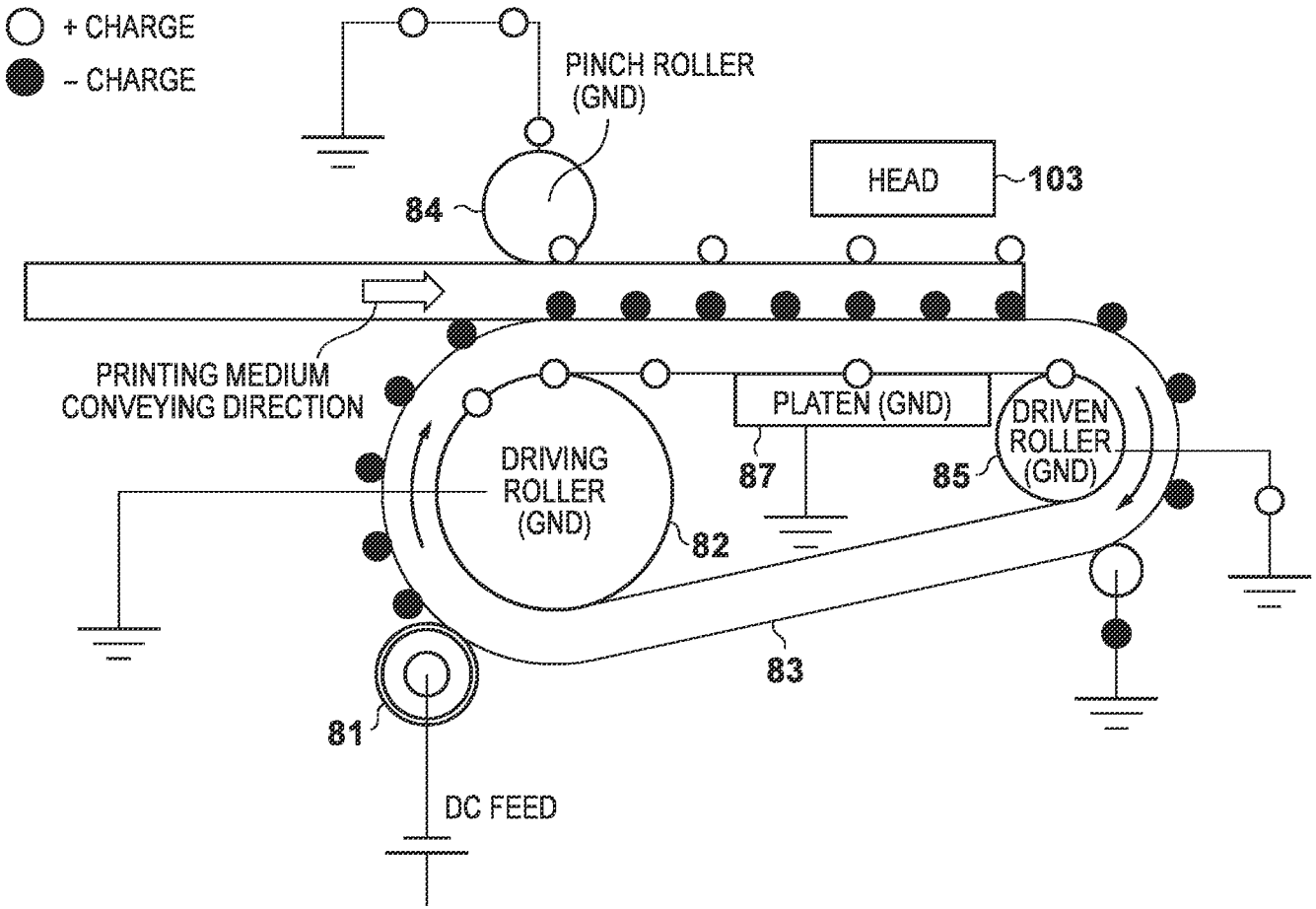
FIG. 10 is a diagram showing a configuration of a printing medium conveying structure portion of an inkjet printing apparatus according a second embodiment.

Next is a description of an example of an inkjet printing apparatus according to the second embodiment. FIG. 10 is a diagram showing the configuration in the vicinity of the structure portion for conveying by electrostatic adsorption in the inkjet printing apparatus according to the present embodiment. The inkjet printing apparatus of the present embodiment differs from the inkjet printing apparatus shown in FIG. 3 in that that the surface potential measuring device 36 is not provided.

The surface potential on the printing medium on an endless belt 83 directly below the printing head is determined based on the amount of charge fed to the endless belt 83 and the amount of charge with the opposite polarity that is applied to the printing medium from a pinch roller 84 that is grounded to GND. As shown in FIG. 10, since −2 kV is applied to a power feed roller 81, due to the discharge phenomenon, a negative charge is present on the endless belt 83, and a positive charge, which has the opposite polarity, is applied to the printing medium from the pinch roller 84 that is grounded to GND.

The resistivity of the endless belt 83, the resistance value of the power feed roller 81, the resistance value of a driving roller 82, and the like are factors that influence the amount of charge fed to the endless belt 83, but do not fluctuate according to a usage condition of the inkjet printing apparatus. However, the power feed condition of the power feed roller 81 is a factor that fluctuates according to a usage condition of the inkjet printing apparatus.

For example, assume that the volume resistivity of the printing medium A is greater than that of the other two types (B and C) of printing media. Here, in the case where the power feed roller 81 is driven for the printing medium A with the same feeding voltage as that in the case of the other two types of printing media, even if the amount of charge applied to the endless belt 83 is the same, the amount of charge on the surface of the printing medium A decreases since the volume resistivity is high, and as a result, the adsorbability between the endless belt 83 and the printing medium A decreases. If the printing medium A is conveyed in this low adsorbability state, the printing medium A may detach from the endless belt 83 or become shifted, and stability will be lacking. Accordingly, in order to realize the same conveying reliability as that with the other two types of printing media, it is necessary to raise the feeding voltage so as to raise both the negative charge and positive charge that contribute to adsorbability. In this way, the power feed condition is modified according to the volume resistivity of each printing medium in consideration of conveying reliability. The reason for this is that the power feed condition is a factor that fluctuates according to a usage condition of the inkjet printing apparatus.

On the other hand, the resistance of the pinch roller 84 that is grounded to GND is a factor that influences the amount of opposite polarity charge applied to the printing medium from the pinch roller 84 grounded to GND, but does not fluctuate according to a usage condition of the inkjet printing apparatus. However, the type of printing medium is a factor that fluctuates according to a usage condition of the inkjet printing apparatus. Specifically, this is because the volume resistivity and surface resistivity of each type of printing medium differs according to mainly the material and density of that type of printing medium.

In general, static electricity is sensitively influenced by humidity. In a low humidity environment, the absolute value of the surface potential on the printing medium on the endless belt 83 directly below the printing head is relatively high. Conversely, in a high humidity environment with a humidity of 75% or higher, the absolute value of the surface potential is low. This is because in general, as the humidity rises, the charge on the endless belt 83 and the opposite polarity charge on the surface of the printing medium decrease. In this way, the humidity in the inkjet printing apparatus influences the amount of charge fed to the endless belt 83 and the amount of opposite polarity charge applied to the printing medium from the pinch roller 84 grounded to GND. Humidity can be said to be a factor that fluctuates according to a usage condition of the inkjet printing apparatus.

As described above, in the inkjet printing apparatus, factors influencing the surface potential on the printing medium on the endless belt 83 directly below the printing head can be separated into factors that fluctuate and do not fluctuate according to a usage condition of the inkjet printing apparatus. Specifically, the humidity, the type of printing medium, and the power feed condition of the power feed roller are factors that influence the surface potential on the printing medium on the endless belt 83 directly below the printing head and fluctuate according to the usage condition of the inkjet printing apparatus. In view of this, in the present embodiment, the surface potential on the printing medium on the endless belt 83 directly below the printing head is acquired based on such information.

The following describes a configuration for acquiring information indicating the humidity, the type of printing medium, and the power feed condition of the power feed roller, and processing for acquiring the surface potential on the printing medium on the endless belt 83 directly below the printing head based on such information, and determining a bidirectional registration adjustment correction value based on the acquired result.

In general, when performing printing on a printing medium using an inkjet printing apparatus, the user designates, in the printer driver, a printing mode that includes settings regarding the printing medium, the printing quality, and the like. In other words, the inkjet printing apparatus can acquire information such as the type of printing medium and the printing quality based on the printing mode designated by the user. Also, optimized parameters for the conveying speed, the adsorbability between the endless belt 83 and the printing medium, and the printing time are set in advance for each type of printing medium that can be designated by the user. The power feed condition for feeding power to the power feed roller 81 is also included among such parameters. In other words, the inkjet printing apparatus can also acquire the power feed condition for feeding power to the power feed roller 81. Also, although not shown in FIG. 10, a humidity sensor is installed inside the inkjet printing apparatus of the present embodiment. Accordingly, the inkjet printing apparatus can acquire information indicating the humidity inside the inkjet printing apparatus at an arbitrary time.

Sequence

Figure 11:
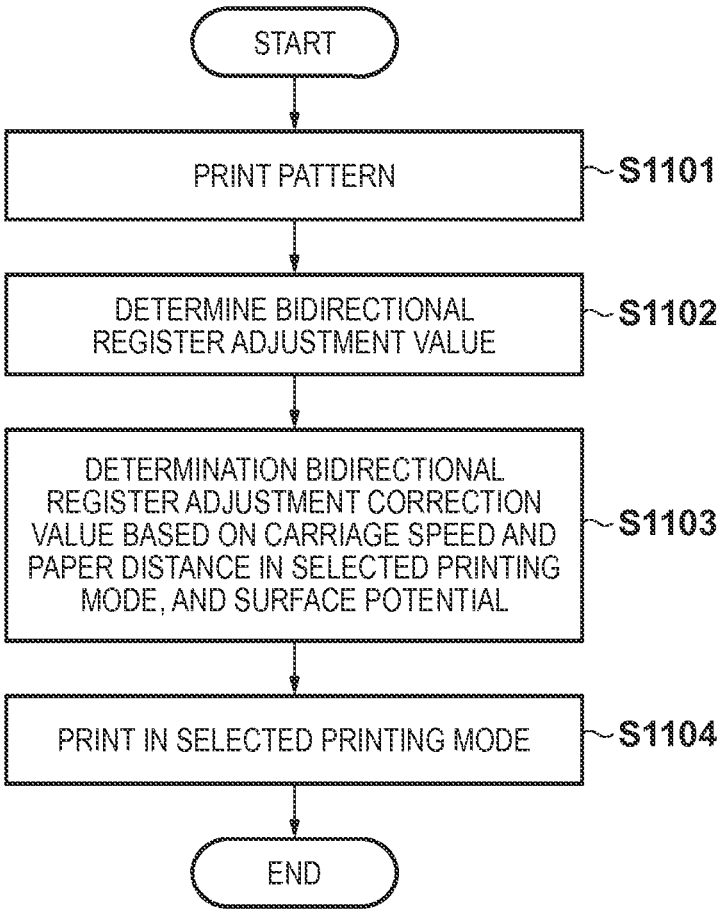
FIG. 11 is a flowchart showing a procedure of bidirectional registration adjustment value correction according to the second embodiment.

FIG. 11 is a flowchart showing an example of a procedure of bidirectional registration adjustment processing performed based on information indicating the humidity, the type of printing medium, and the condition of power feeding to the power feed roller. First, a color pattern, for example, is printed for the purpose of performing adjustment regarding the landing of ink drops discharged from the printing head (S1101). Next, a bidirectional registration adjustment value is determined based on the printed color pattern (S1102). The processing for determining the bidirectional registration adjustment value conforms to that of a conventional method.

Here, as shown in FIG. 12, the inkjet printing apparatus stores in advance a table associating surface potentials with types of printing media (corresponding to thicknesses and paper distances), power feed conditions, and humidities. Next, the surface potential is acquired based on the type of printing medium, the power feed condition, and humidity information detected by the humidity sensor.

Subsequently, a bidirectional registration adjustment correction value is determined based on the surface potential and the carriage speed and type of printing medium in the printing mode selected by the user. After the bidirectional registration adjustment correction value has been determined in S1103, printing is performed in the selected printing mode (S1104).

The above has described the configuration shown in FIG. 10 as an example of an embodiment for obtaining information indicating, for example, the humidity, the type of printing medium, and the condition of power feeding to the power feed roller. However, another configuration may be used as long as it is possible to acquire information indicating, for example, the humidity, the type of printing medium, and the condition of power feeding to the power feed roller 81, and it is possible to acquire the surface potential on the printing medium on the endless belt 83 directly below the printing head. For example, a configuration is possible in which a sensor that detects the type of printing medium is provided, and information indication the type of printing medium is acquired based on the detection result.

Effects

The following described effects achieved by the configuration according to the present embodiment. For three types of printing media (a reference medium and printing media A and B), the surface potential on the printing medium on the endless belt 83 directly below the printing head was acquired in a 50% humidity environment and an 80% humidity environment based on the humidity, the type of printing medium, and the condition of power feeding to the power feed roller 81, and the granular quality was evaluated in each case. FIG. 13 is a diagram showing the results of this evaluation. Here, a gray pattern was printed through 4-pass multi-pass printing.

The printer 1 shown in FIG. 13 was a conventional inkjet printing apparatus that does not acquire the surface potential on the printing medium on the endless belt 83 directly below the printing head based on the humidity, the type of printing medium, and the condition of power feeding to the power feed roller 81. Also, the bidirectional registration adjustment correction value that was used was determined based on the carriage speed and the paper distance as in the conventional method. On the other hand, with the printer 2, the surface potential on the printing medium on the endless belt 83 directly below the printing head was acquired based on the humidity, the type of printing medium, and the condition of power feeding to the power feed roller 81, and the bidirectional registration adjustment correction value was determined based on the acquired surface potential. Also, for both the printer 1 and the printer 2, bidirectional registration adjustment processing that was to serve as a reference was executed for the reference medium in a 50% humidity environment.

As shown in FIG. 13, with the printer 1, a smooth image having no granular quality was obtained only on the reference medium on which bidirectional registration adjustment was carried out and on the printing medium A in the 80% humidity environment, and although there was a certain extent of variation in the other cases, a rough image with degraded granular quality was obtained in these other cases. The surface potential on the printing medium directly below the printing head when printing was performed on the printing medium A in the 80% humidity environment was coincidentally the same as that in the case where bidirectional registration adjustment was performed on the reference medium in the 50% humidity environment, and therefore the same result (double circle) was obtained. In other words, the discharge speed of ink drops discharged from the printing head was coincidentally the same, and therefore no shift occurred in the bidirectional registration adjustment value. However, different results (single circle or triangle) were obtained in the other cases. This was because regardless of the fact that the surface potential on the printing medium directly below the printing head differs due to differences in the humidity, the type of printing medium, and the condition of power feeding to the power feed roller 81, the bidirectional registration adjustment value that was used was determined when performing printing on the reference medium in the 50% humidity environment. Accordingly, the evaluations of granular quality differed.

On the other hand, with the printer 2, the surface potential on the printing medium on the endless belt 83 directly below the printing head was acquired from the table shown in FIG. 12 based on the humidity, the type of printing medium, and the condition of power feeding to the power feed roller 81, and the bidirectional registration adjustment correction value was determined based on the acquired surface potential. With the printer 2, a smooth gray image having no granular quality, which was substantially the same as that in the case of printing a gray pattern in a 50% humidity environment through 4-pass multi-pass printing on the reference medium on which registration adjustment was performed, was output on the printing media A and B in the 50% humidity environment and the 80% humidity environment. This is due to the fact that, even if the surface potential on the printing medium on the endless belt 83 directly below the printing head differs for the three types of printing media similarly to the printer 1, the discharge timing is properly corrected based on the amount of difference in ink drop speed discharge speed.

As described above, it was found that a significant effect is achieved by acquiring the surface potential on the printing medium on the endless belt 83 directly below the printing head based on the humidity, the type of printing medium, and the condition of power feeding to the power feed roller 81, and determining the bidirectional registration adjustment correction value based on the acquired surface potential.

In the present embodiment, a two-layer belt (medium adsorption surface side: 1×10^15 [Ωcm] or greater, and medium non-adsorption surface side: 1×10^7 [Ωcm] or greater) is used as the endless belt 83. However, a configuration is possible in which a single-layer belt is used, and the bidirectional registration adjustment correction value is determined with respect to the surface potential on the printing medium directly below the printing head. Also, although the voltage applied from the power feed roller 81 to the endless belt 83 has a negative polarity in the present embodiment, this voltage may have a positive polarity.

As described above, in the present embodiment, a DC static charge is applied to the endless belt 83, and the surface potential on the printing medium on the endless belt 83 directly below the printing head is acquired based on the humidity, the type of printing medium, and the condition of power feeding to the power feed roller 81. A bidirectional registration adjustment correction value is then determined in accordance with the acquired surface potential, and the ink drop discharge timing is controlled. As a result, it is possible to correct change in the discharge speed that occurs according to differences in printing medium surface potential, and it is possible to prevent image degradation that occurs due to bidirectional registration adjustment shift.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-279861, filed Dec. 15, 2010, which is hereby incorporated by reference herein in its entirety.

What is claimed is:

1. An inkjet printing apparatus for performing printing based on image data by scanning a printing head in a direction that intersects a conveying direction of a printing medium, and discharging ink from the printing head onto the printing medium, comprising:

a conveying unit that has a roller that drives an endless belt and a static charge unit that charges the belt, configured to convey the printing medium in the conveying direction by causing the printing medium to adsorb to a surface of the belt by electrostatic force, and causing the belt to be driven by the roller;

an acquisition unit configured to acquire a surface potential of the printing medium that has been conveyed to a position directly below the printing head by the conveying unit when printing is performed based on test data by discharging ink from the printing head onto the printing medium;

a determination unit configured to obtain a discharge speed of the ink that has been associated in advance with the surface potential acquired by the acquisition unit, and configured to determine an amount of variation in a landing position of the ink on the printing medium based on a scanning speed of the printing head, a distance from the printing head to the printing medium, and the discharge speed of the ink;

a correction unit configured to correct a timing according to which the ink is discharged from the printing head so as to cancel out the amount of variation in the landing position determined by the determination unit; and a printing unit configured to perform printing based on the image data by discharging ink from the printing head onto the printing medium in accordance with the timing corrected by the correction unit.

2. The inkjet printing apparatus according to claim 1, wherein the acquisition unit acquires the surface potential of the printing medium that has been conveyed to the position directly below the printing head by the conveying unit, using a potential measuring device provided in a vicinity of the printing head.

3. The inkjet printing apparatus according to claim 1, further comprising:

a humidity sensor configured to detect a humidity, wherein the acquisition unit acquires the surface potential of the printing medium that has been conveyed to the position directly below the printing head by the conveying unit, based on the humidity detected by the humidity sensor, the type of the printing medium, and a power feed condition of power feeding to the static charge unit.

4. The inkjet printing apparatus according to claim 1, wherein the determination unit determines the amount of variation in the landing position of the ink on the printing medium by performing calculation using the scanning speed of the printing head, the distance from the printing head to the printing medium, and the discharge speed of the ink.

5. An ink discharge control method executed in an inkjet printing apparatus comprising a conveying unit that has a roller that drives an endless belt and a static charger that charges the belt, and that conveys a printing medium in a conveying direction by causing the printing medium to adsorb to a surface of the belt by electrostatic force, and causing the belt to be driven by the roller, the inkjet printing apparatus performing printing based on image data by scanning a printing head in a direction that intersects the conveying direction of the printing medium, and discharging ink from the printing head onto the printing medium, the ink discharge control method comprising:

an acquiring step of acquiring a surface potential of the printing medium that has been conveyed to a position directly below the printing head by the conveying unit when printing is performed based on test data by discharging ink from the printing head onto the printing medium;

a determining step of obtaining a discharge speed of the ink that has been associated in advance with the surface potential acquired in the acquiring step, and determining an amount of variation in a landing position of the ink on the printing medium based on a scanning speed of the printing head, a distance from the printing head to the printing medium, and the discharge speed of the ink;

a correcting step of correcting a timing according to which the ink is discharged from the printing head so as to cancel out the amount of variation in the landing position determined in the determining step; and a printing step of performing printing based on the image data by discharging ink from the printing head onto the printing medium in accordance with the timing corrected in the correcting step.

6. An inkjet printing apparatus for performing printing based on image data by scanning a printing head in a direction that intersects a conveying direction of a printing medium, and discharging ink from the printing head onto the printing medium, comprising:

an endless belt that conveys the printing medium;

a static charge unit that charges the belt in order to cause the printing medium to adsorb to a surface of the endless belt;

an acquisition unit that acquires a surface potential of the printing medium that has been adsorbed to the endless belt; and a control unit that performs control such that compared to a case where the surface potential of the printing medium acquired by the acquisition unit is a first potential, a discharge timing of ink discharged from the printing head during scanning is later in a case where the surface potential of the printing medium is a second potential whose absolute value is greater than that of the first potential.

7. The inkjet printing apparatus according to claim 6, wherein the control unit performs control such that compared to the case where the surface potential of the printing medium is the first potential, a discharge timing of ink corresponding to a specified pixel in the image data is later in the case where the surface potential of the printing medium is the second potential.

8. The inkjet printing apparatus according to claim 6, wherein in a case where a scanning speed of the printing head and a distance from the printing head to the printing medium are the same in the case where the surface potential of the printing medium is the first potential and the case where the surface potential of the printing medium is the second potential, the control unit performs control such that compared to the case where the surface potential of the printing medium is the first potential, the discharge timing of the ink discharged from the printing head is later in the case where the surface potential of the printing medium is the second potential.

9. An inkjet printing apparatus comprising:

a conveying unit configured to convey a printing medium by attracting the printing medium to a belt;

a printhead configured to discharge ink on the printing medium attracted to the belt;

a determining unit configured to determine an ink discharging timing from the printhead based on a test pattern printed on the printing medium;

an obtaining unit configured to obtain a surface potential of the printing medium on which an image is to be printed by the printhead; and a correcting unit configured to correct the ink discharging timing determined by said determining unit based on the surface potential obtained by said obtaining unit and a reference surface potential, wherein the reference surface potential is the surface potential of the printing medium on which the test pattern is printed.

10. The inkjet printing apparatus according to claim 9, wherein said obtaining unit obtains the surface potential of the printing medium by a potential measuring device configured to face the printing medium.

11. The inkjet printing apparatus according to claim 9, further comprising:

a humidity sensor configured to detect humidity; and a charging unit configured to charge the belt, wherein said obtaining unit obtains the surface potential of the printing medium based on the humidity detected by said humidity sensor and a power feeding condition for feeding to said charging unit.

12. The inkjet printing apparatus according to claim 9, further comprising a carriage configured to mount the printhead and to move in a direction which crosses a conveyance direction of the printing medium.

13. The inkjet printing apparatus according to claim 12, wherein the ink discharging timing corresponds to a relative timing between a timing when the carriage moves in a forward direction and a timing when the carriage moves in a reverse direction.

* * * * *